US011441833B2

(12) United States Patent
Oh et al.

(10) Patent No.: US 11,441,833 B2
(45) Date of Patent: Sep. 13, 2022

(54) ENTRANCE REFRIGERATOR

(71) Applicant: LG ELECTRONICS INC., Seoul (KR)

(72) Inventors: Minkyu Oh, Seoul (KR); Insun Yeo, Seoul (KR); Kyukwan Choi, Seoul (KR); Yezo Yun, Seoul (KR); Yanghwan No, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 297 days.

(21) Appl. No.: 16/798,683

(22) Filed: Feb. 24, 2020

(65) Prior Publication Data

US 2020/0271370 A1 Aug. 27, 2020

(30) Foreign Application Priority Data

Feb. 25, 2019 (KR) ..... 10-2019-0021867
Jul. 18, 2019 (KR) ..... 10-2019-0086930

(51) Int. Cl.
*F25B 21/02* (2006.01)
*F25D 23/02* (2006.01)
*F25D 21/14* (2006.01)

(52) U.S. Cl.
CPC ..... *F25D 21/14* (2013.01); *F25B 21/02* (2013.01); *F25D 23/028* (2013.01)

(58) Field of Classification Search
CPC ..... F25B 21/02; F25B 2321/0212; F25B 2321/0251; F25D 23/10; F25D 2321/1413; F25D 2321/1441; F25D 2323/02
See application file for complete search history.

(56) References Cited

U.S. PATENT DOCUMENTS 3,078,682 A 2/1963 Gould
3,177,678 A 4/1965 Facey, Jr.
(Continued)

FOREIGN PATENT DOCUMENTS

CA 2461635 A1 9/2005
CN 2165389 Y 5/1994
(Continued)

OTHER PUBLICATIONS

U.S. Office Action for U.S. Appl. No. 16/798,962, dated Oct. 21, 2021.
(Continued)

*Primary Examiner* — Ana M Vazquez
(74) *Attorney, Agent, or Firm* — Birch, Stewart, Kolasch & Birch, LLP

(57) ABSTRACT

A cold air supply device is applied to an entrance refrigerator. The cold air supply device includes a thermoelectric element forming a heat absorbing surface and a heat generating surface, a cold sink in contact with the heat absorbing surface, a heat absorption fan disposed above the cold sink, a heat sink in contact with the heat generating surface, a heat dissipation fan disposed below the heat sink, and an insulation material disposed between the cold sink and the heat sink to block heat transfer. The cold sink includes a sink body, and a plurality of heat exchange fins arranged on the upper surface of the sink body. Absorption pads are provided on both side edges of the sink body to absorb condensed water generated on the surface of the cold sink.

20 Claims, 15 Drawing Sheets

(56) References Cited

U.S. PATENT DOCUMENTS

| | | | |
|---|---|---|---|
| 4,726,193 | A | 2/1988 | Burke et al. |
| 4,738,113 | A | 4/1988 | Rudick |
| 5,315,830 | A | 5/1994 | Doke et al. |
| 5,774,053 | A | 6/1998 | Porter |
| 7,308,796 | B1 | 12/2007 | Eager |
| 7,934,384 | B2 | 5/2011 | Tuskiewicz et al. |
| 2003/0084670 | A1 | 5/2003 | Kim et al. |
| 2004/0210153 | A1* | 10/2004 | Tsukashima ..... A61M 15/0003 600/532 |
| 2005/0122682 | A1 | 6/2005 | Streit et al. |
| 2005/0210884 | A1 | 9/2005 | Tuskiewicz et al. |
| 2006/0118274 | A1 | 6/2006 | Lee et al. |
| 2017/0213187 | A1 | 7/2017 | Choi et al. |
| 2017/0251833 | A1 | 9/2017 | Stolarz et al. |
| 2018/0087822 | A1 | 3/2018 | Han et al. |
| 2018/0087824 | A1 | 3/2018 | Han et al. |
| 2018/0187944 | A1 | 7/2018 | Park et al. |
| 2018/0283765 | A1 | 10/2018 | Yi et al. |
| 2019/0033897 | A1 | 1/2019 | Barbier |

FOREIGN PATENT DOCUMENTS

| | | | |
|---|---|---|---|
| CN | 101210760 | A | 7/2008 |
| CN | 201277783 | Y | 7/2009 |
| CN | 102589236 | A | 7/2012 |
| CN | 102914119 | A | 2/2013 |
| CN | 102927748 | A | 2/2013 |
| CN | 203534032 | U | 4/2014 |
| CN | 105389944 | A | 3/2016 |
| CN | 105867189 | A | 8/2016 |
| CN | 206257869 | U | 6/2017 |
| CN | 206362072 | U | 7/2017 |
| CN | 107084583 | A | 8/2017 |
| CN | 107440482 | A | 12/2017 |
| CN | 207006712 | U | 2/2018 |
| CN | 108344233 | A | 7/2018 |
| CN | 108458540 | A | 8/2018 |
| CN | 108471893 | A | 8/2018 |
| CN | 207922675 | U | 9/2018 |
| CN | 207922676 | U | 9/2018 |
| CN | 108882798 | A | 11/2018 |
| CN | 108917256 | A | 11/2018 |
| EP | 1004487 | B1 | 6/2005 |
| EP | 2980511 | A1 | 2/2016 |
| FR | 1347414 | A | 11/1963 |
| JP | 5-149675 | A | 6/1993 |
| JP | 7-204447 | A | 8/1995 |
| JP | 10-267501 | A | 10/1998 |
| JP | 11-94423 | A | 4/1999 |
| JP | 2017-198360 | A | 11/2017 |
| JP | 2018-186045 | A | 11/2018 |
| KR | 10-2011-0033394 | A | 3/2011 |
| KR | 10-2018-0105572 | A | 9/2018 |
| TW | 499559 | B | 8/2002 |
| WO | WO 97/41542 | A1 | 11/1997 |
| WO | WO 2006/087690 | A2 | 8/2006 |
| WO | WO 2018/169178 | A1 | 9/2018 |

OTHER PUBLICATIONS

U.S Office Action dated Apr. 4, 2022 for U.S. Appl. No. 16/798,617.
U.S. Office Action for U.S. Appl. No. 16/798,778, dated Jun. 14, 2022.

* cited by examiner

ENTRANCE REFRIGERATOR

CROSS-REFERENCE TO RELATED APPLICATIONS

The present application claims the benefits of priority to Korean Patent Application No. 10-2019-0021867, filed on Feb. 25, 2019, and Korean Patent Application No. 10-2019-0086930, filed on Jul. 18, 2019, all of which are herein incorporated by reference in their entireties.

BACKGROUND

The present disclosure relates to a refrigerator installed at an entrance of a building, such as a home or a business.

Recently, delivery services for delivering fresh goods to predetermined places are being utilized. In particular, when the goods are fresh food, a delivery vehicle is provided with a refrigerator or a warmer to store and deliver the food so as to prevent the food from spoiling or cooling.

Generally, the food is packed in a packaging material and delivered so as to keep the food cool or warm, depending on the type of food. The packaging material is often composed of environmental pollutants such as polystyrene foam. The social atmosphere recently has placed an emphasis on a reduction of an amount of packaging material used.

When a user is at home at the time of a delivery, the delivery person may deliver the food to the user in a face-to-face manner. However, when the user is not at home or when the delivery time is too early or too late, it is difficult for the delivery person to deliver the food in a face-to-face manner.

Therefore, there is a need to be able to deliver the food even if the delivery person does not face the user, and to prevent the food from spoiling or cooling until the food is finally delivered to the user.

To solve this problem, in recent years, a product has been introduced in which a refrigerator is installed at an entrance (e.g. a front door) of a predetermined place, so that a delivery person can deliver the food into the refrigerator in order to keep the food fresh until a user can receive the food by accessing the refrigerator at a convenient time.

Korean Patent Application Publication No. 2011-0033394 (Mar. 31, 2011) discloses an entrance refrigerator mounted on a front door.

When a thermoelectric element is used for cooling the storage compartment of the entrance refrigerator, condensation is formed on a surface of a cold sink attached to a heat absorbing surface of the thermoelectric element that reduces the heat exchange ability of the cold sink.

In addition, condensed water formed at the cold sink flows down to drop on the bottom of the entrance refrigerator, and drops down on the floor of the entrance through a gap formed at the bottom of the entrance refrigerator.

Therefore, there is a need for a structure or a method capable of controlling condensation formed on the surface of a cold sink.

SUMMARY

The present disclosure has been proposed to improve the above-described problems.

An object of the present disclosure is to provide an entrance refrigerator having a structure in which condensed water generated on a surface of a thermoelectric element and flowing along a bottom of a cold sink is quickly collected to prevent the condensed water from being frozen on the surface of the cold sink or flowing to the outside of the entrance refrigerator.

A cold air supply device may be applied to an entrance refrigerator according to one embodiment. The cold air supply device may include a thermoelectric element forming a heat absorbing surface and a heat generating surface, a cold sink in contact with the heat absorbing surface, a heat absorption fan disposed above the cold sink, a heat sink in contact with the heat generating surface, a heat dissipation fan disposed below the heat sink, and an insulation material disposed between the cold sink and the heat sink to block heat transfer.

In addition, the cold sink may include a sink body, and a plurality of heat exchange fins arranged on the upper surface of the sink body. Absorption pads may be mounted on both side edges of the sink body to absorb condensed water generated on the surface of the cold sink.

In addition, a controller of the entrance refrigerator is configured to stop the supply of power to the thermoelectric element to permit heat to transfer from the heat generating surface to the heat absorbing surface and the cold sink. Therefore, frost formed on the cold sink is melted and flows to the absorption pads. The water absorbed by the absorption pads is evaporated by the heat. In this manner, a natural defrosting may be performed.

In addition, the controller is configured to stop the supply of power to the thermoelectric element and the heat dissipation fan, and drives only the heat absorption fan, such that the water absorbed by the absorption pads is evaporated by air in the storage compartment forcibly flowing due to the heat absorption fan. In this manner, the natural defrosting may be performed.

In addition, the controller is configured to supply a reverse voltage to the thermoelectric element to increase the temperatures of the heat absorption surface and the cold sink. The frost formed on the cold sink is melted and flows to the absorption pads, and the water absorbed by the absorption pads is evaporated by the heat.

In addition, the controller is configured to rotate the heat absorption fan such that the water absorbed by the absorption pads is evaporated by air in the storage compartment forcibly flowing due to the heat absorption fan.

In addition, when the water absorbed by the absorption pads is evaporated to complete the defrosting operation, the controller is configured to selectively perform the cooling operation of cooling the storage compartment according to the internal temperature of the storage compartment.

The entrance refrigerator configured as described above according to the embodiment has the following effects.

In detail, since the absorption pads are mounted on both side edges of the sink body constituting the cold sink attached on the heat absorbing surface of the thermoelectric element, condensed water flowing down along the surface of the heat exchange fins is absorbed by the absorption pads.

In addition, since cold air in the storage compartment forcibly flowing due to the rotation of the heat absorption fan evaporates the condensed water absorbed in the absorption pads, a separate container for storing condensed water is not required, and a discharge pump for discharging the condensed water is not required.

In addition, since the condensed water is absorbed by the absorption pads, it is possible to prevent condensed water from flowing into a housing through a gap formed at the edge of the sink body, and to prevent condensed water from leaking to the outside of the housing and dropping to the floor of the entrance.

The details of one or more embodiments are set forth in the accompanying drawings and the description below. Other features will be apparent from the description and drawings, and from the claims.

DETAILED DESCRIPTION OF THE EMBODIMENTS

Hereinafter, an entrance refrigerator 10 according to an embodiment will be described in detail with reference to the accompanying drawings.

Figure 1:
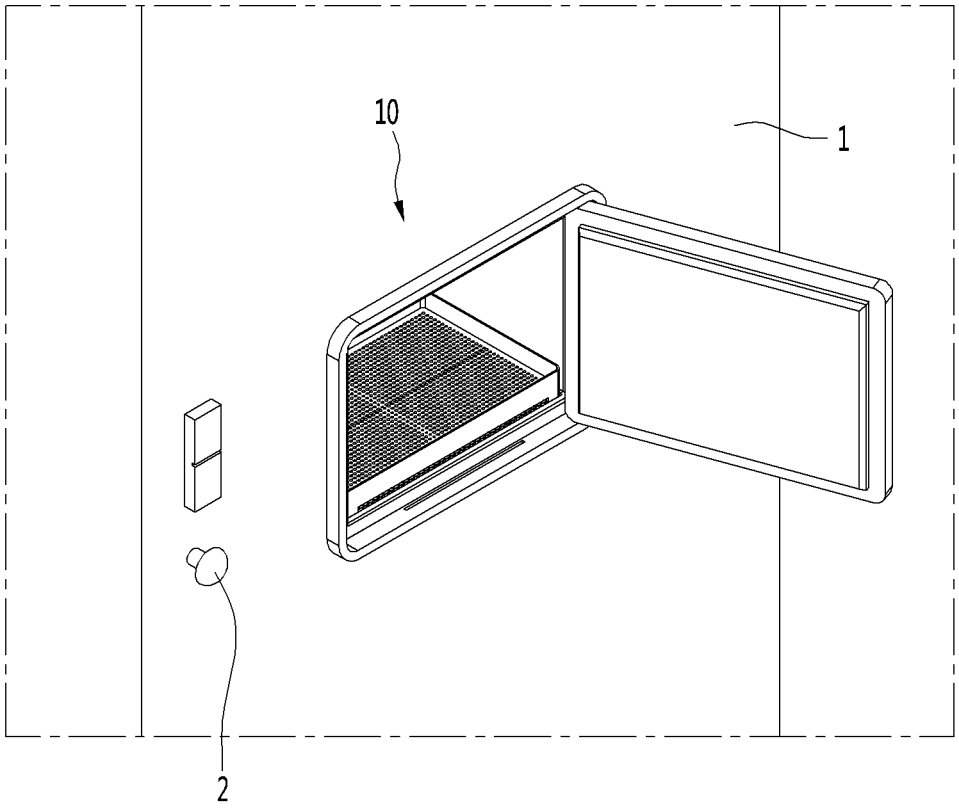
FIG. 1 is a front view of an entrance refrigerator installed at a front door, according to an embodiment.
Figure 2:
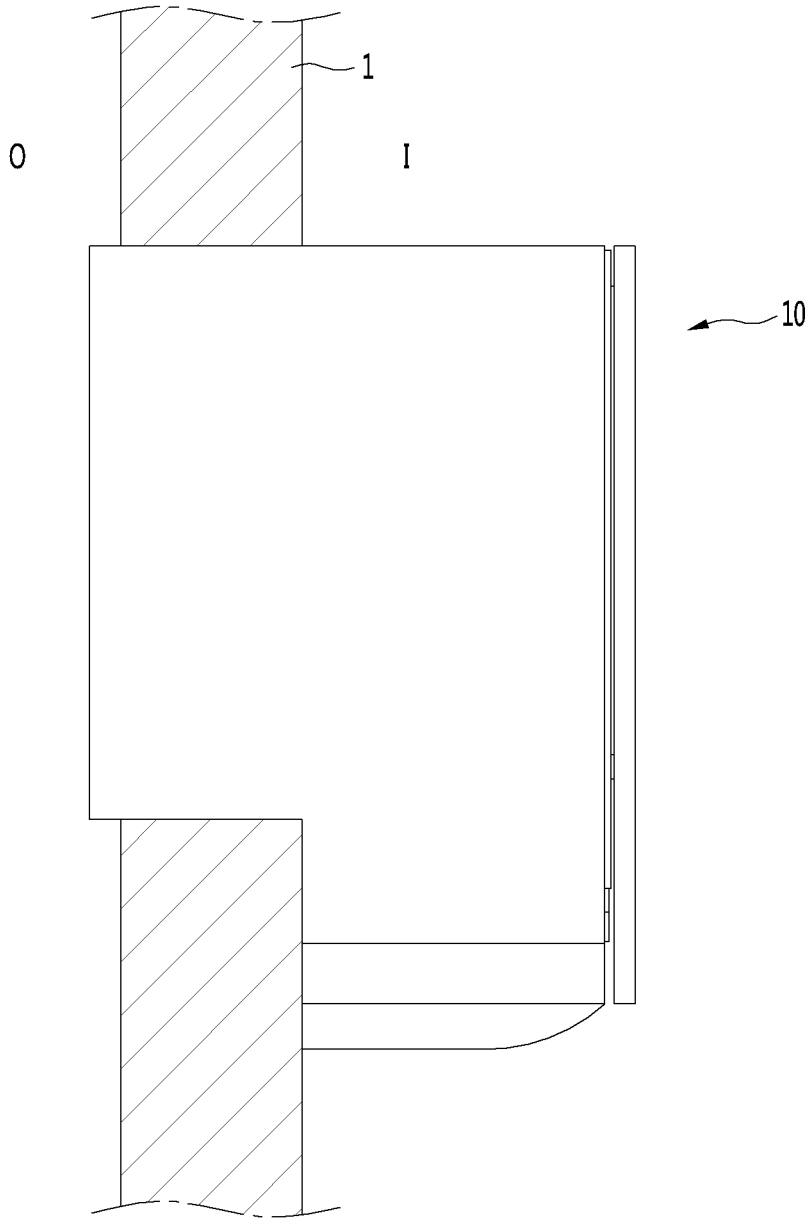
FIG. 2 is a side view of the entrance refrigerator installed at the front door, according to an embodiment.

FIG. 1 is a front view of an entrance refrigerator 10 according to an embodiment installed at a front door of a building, such as a residence, and FIG. 2 is a side view of the entrance refrigerator 10 installed at the front door, according to an embodiment.

Referring to FIGS. 1 and 2, the entrance refrigerator 10 according to the embodiment may be mounted by passing through a suitably-sized opening in a front door 1 or a front wall of a house.

In detail, the entrance refrigerator 10 may be mounted at a point spaced apart from a knob 2 of the front door 1, for example, the entrance refrigerator 10 may be mounted at the center of the front door 1.

In addition, the entrance refrigerator 10 is preferably installed at a height within two meters from the bottom of the front door 1 for convenience of a user and for convenience to a delivery person who delivers goods to the entrance refrigerator 10. Preferably, the entrance refrigerator 10 may be installed at a height in a range of 1.5 meters to 1.7 meters from the bottom of the front door 1.

One portion of the entrance refrigerator 10 is exposed to the outside O (outdoors), and another portion of the entrance refrigerator 10 is exposed to the inside I (indoors). For example, in the entrance refrigerator 10, the surface exposed to the outside O may be defined as the front surface (or outdoor portion) at the front side (exterior side) of the door or wall, and the surface exposed to the inside I may be defined as the rear surface (or indoor portion) at the rear side (interior side) of the door or wall. The door or wall provides a barrier in or around a building, such as, but not limited to, a house, apartment, office, hospital, or the like.

Hereinafter, the configuration of the entrance refrigerator 10 according to the embodiment will be described in more detail with reference to the accompanying drawings.

Figure 3:
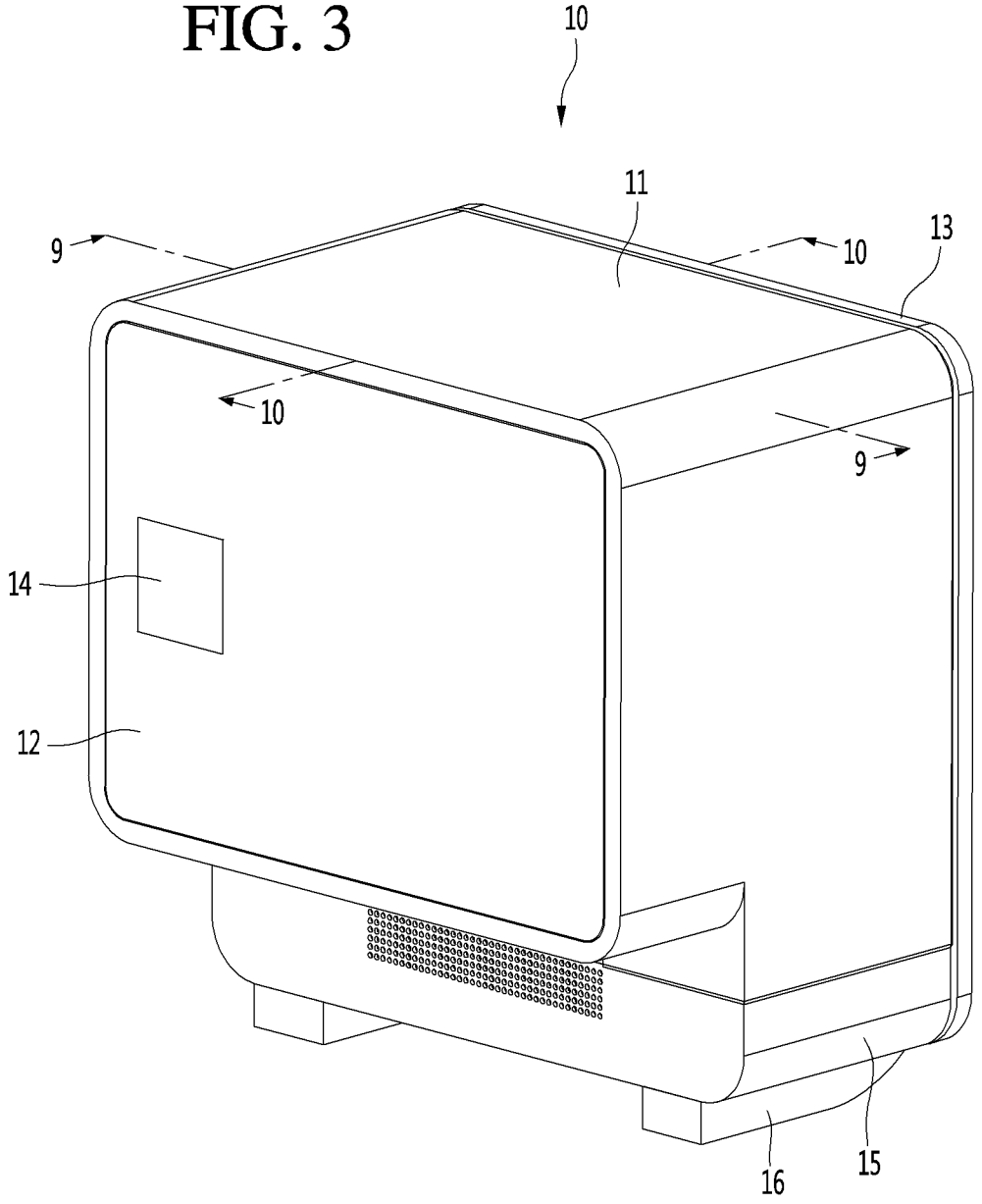
FIG. 3 is a front perspective view of the entrance refrigerator according to an embodiment.
Figure 4:
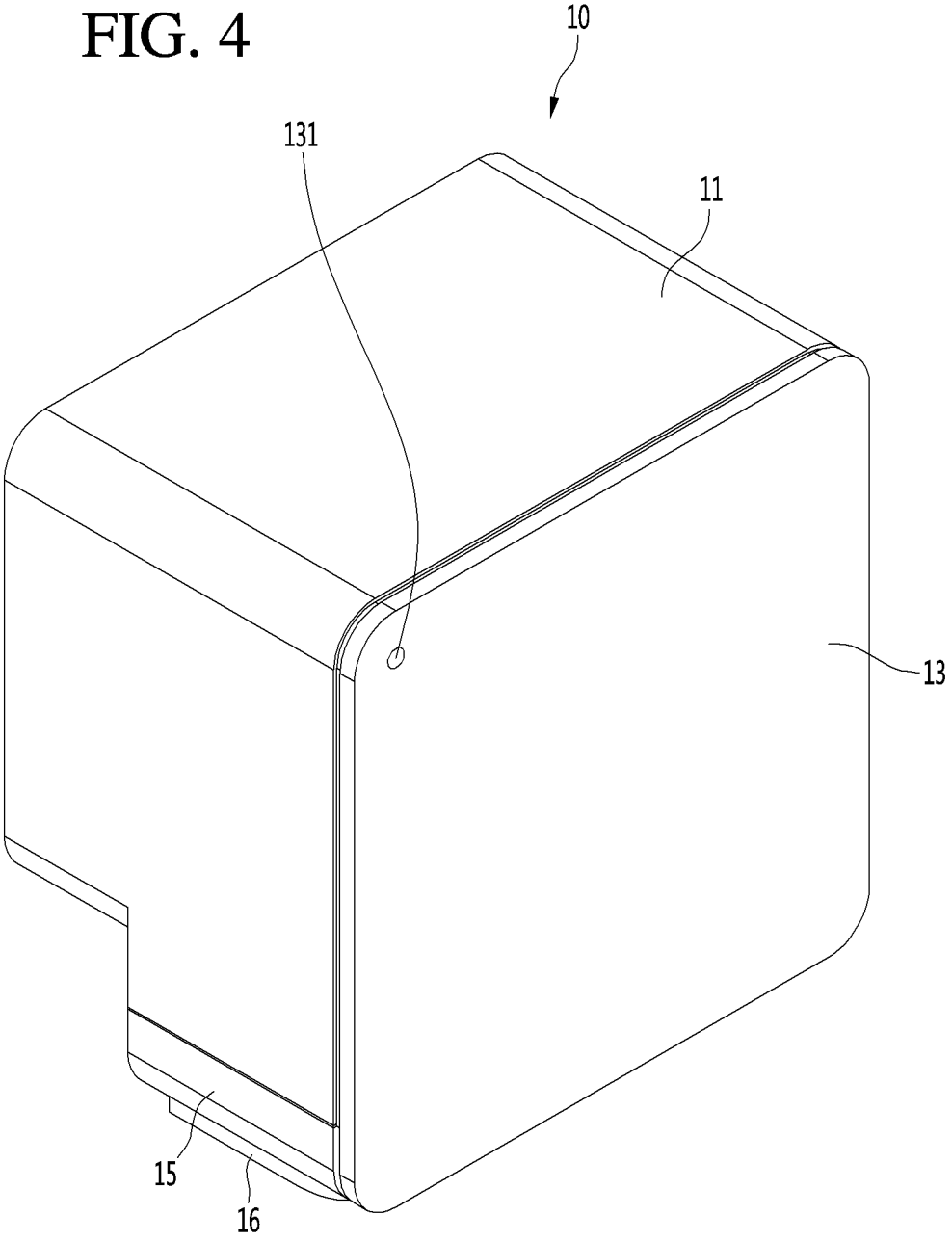
FIG. 4 is a rear perspective view of the entrance refrigerator according to an embodiment.
Figure 5:
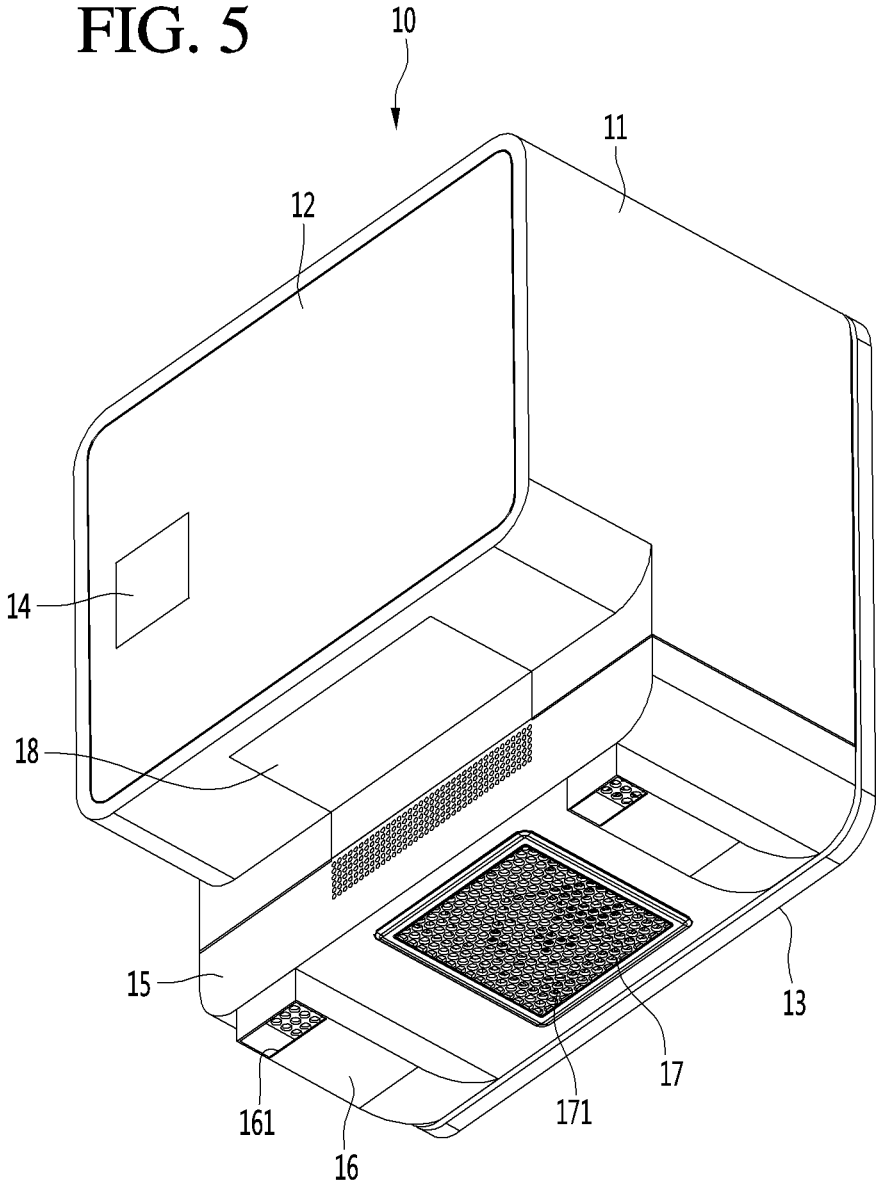
FIG. 5 is a bottom perspective view of the entrance refrigerator according to an embodiment.

FIG. 3 is a front perspective view of the entrance refrigerator 10 according to an embodiment, FIG. 4 is a rear perspective view of the entrance refrigerator 10, and FIG. 5 is a bottom perspective view of the entrance refrigerator 10.

Referring to FIGS. 3 to 5, the entrance refrigerator 10 according to the embodiment may include a cabinet 11, an outdoor side door 12, an indoor side door 13, and a housing 15.

The cabinet 11 has a front opening provided in a portion of the cabinet 11 located at the front (exterior) side of the door or exterior wall, and a rear opening provided in a portion of the cabinet 11 located at the rear (interior) side of the door or interior wall. The cabinet 11 may have an approximately hexahedral shape with a front wall and a rear wall interconnected by a plurality of side walls. The front opening may be provided in the front wall of the cabinet 11, and the rear opening may be provided in the rear wall of the cabinet 11, although the embodiment is not limited thereto. For example, the front opening and the rear opening may be provided on a same side of the cabinet 11 depending on the location where the entrance refrigerator 10 is being installed. The outdoor side door 12 may be rotatably coupled to the cabinet 11 so as to selectively open or close the front opening of the cabinet 11. The outdoor side door 12 may be opened by the delivery person in order to store goods in the entrance refrigerator 10. In addition, the outdoor side door 12 may be opened by the user so as to withdraw goods from the entrance refrigerator 10.

Here, the term "user" is defined as a person who has ordered goods that are stored in the entrance refrigerator 10 by the delivery person, or as a person having authority to release the goods from the entrance refrigerator 10.

In addition, the indoor side door 13 may be rotatably coupled to the cabinet 11 so as to selectively open or close the rear opening of the cabinet 11.

A display 14 may be provided on the outdoor side door 12. The display 14 may display information about an operating state of the entrance refrigerator 10, an internal temperature of the entrance refrigerator 10, and the presence or absence of goods in the entrance refrigerator 10.

In addition, the delivery person who delivers goods may input a password or the like through the display 14 for opening the outdoor side door 12.

A code scanner for recognizing an encryption code provided in a shipping order or a shipping box may be provided on one side of the outdoor side door 12.

The indoor side door 13 is used by the user within the house to take out goods stored in the entrance refrigerator 10. That is, the user can open the indoor side door 13 to withdraw the goods from the entrance refrigerator 10 and into the house.

A guide light 131 may be provided at one side of the indoor side door 13. The guide light 131 may be a device for informing a user whether or not goods are currently stored in the entrance refrigerator 10. For example, the color of the guide light 131 may be set differently depending on whether goods are stored in the entrance refrigerator 10 or whether the entrance refrigerator 10 is empty. The user may recognize whether there are goods currently being stored even without opening the indoor side door 13.

The housing 15 is provided at the lower end of the cabinet 11, either integrally as part of the cabinet 11 or as a separate element attached to the cabinet 11. A cold air supply device 30 (cold air supplier), to be described later, is accommodated in the housing 15. The front surface of the housing 15 comes into close proximity with the rear surface of the front door 1 or the wall when the entrance refrigerator 10 is mounted on the front door 1 or the wall, and contact between a portion of the front surface of the housing 15 and the rear surface of the front door 1 or the wall cancels the moment due to the eccentric load of the entrance refrigerator 10 within the opening of the front door 1 or the wall.

In detail, the entrance refrigerator 10 according to the embodiment has a structural characteristic in which a volume of a part exposed indoors is larger than a volume of a part exposed outdoors of the front door 1. Therefore, the center of gravity of the entrance refrigerator 10 is formed at a point eccentric rearwardly of the center of the entrance refrigerator 10. As a result, the moment is generated by the load of the entrance refrigerator 10 and the load of goods stored therein. With such an arrangement, it is possible that the entrance refrigerator 10 could be pulled out of the front door 1 by the moment.

However, since the front surface of the housing 15 contacts the rear surface of the front door 1 or the wall, the moment acting on the entrance refrigerator 10 is cancelled, thereby preventing the entrance refrigerator 10 from being separated from the front door 1.

A pair of guide ducts 16 may be provided at left and right edges of the bottom surface of the housing 15. A discharge port 161 is formed at the front end of each guide duct 16 so that indoor room air, which flows into the cold air supply device 30 in the housing 15 and performs a heat dissipation function, may be discharged out of the housing 15.

A guide plate 18 may be provided on an angled surface of the cabinet 11 formed by the bottom surface of the cabinet 11 and the front surface of the housing 15. The function of the guide plate 18 will be described below with reference to the accompanying drawings.

An opening for suctioning indoor room air may be formed in the bottom surface of the housing 15, and a suction plate 17 may be mounted at the opening. A plurality of through-holes 171 may be formed in the suction plate 17, and indoor room air is introduced into the housing 15 through the plurality of through-holes 171. At least part of the indoor room air introduced into the housing 15 is discharged back out of the housing 15 through the discharge ports 161 of the guide ducts 16.

Figure 6:
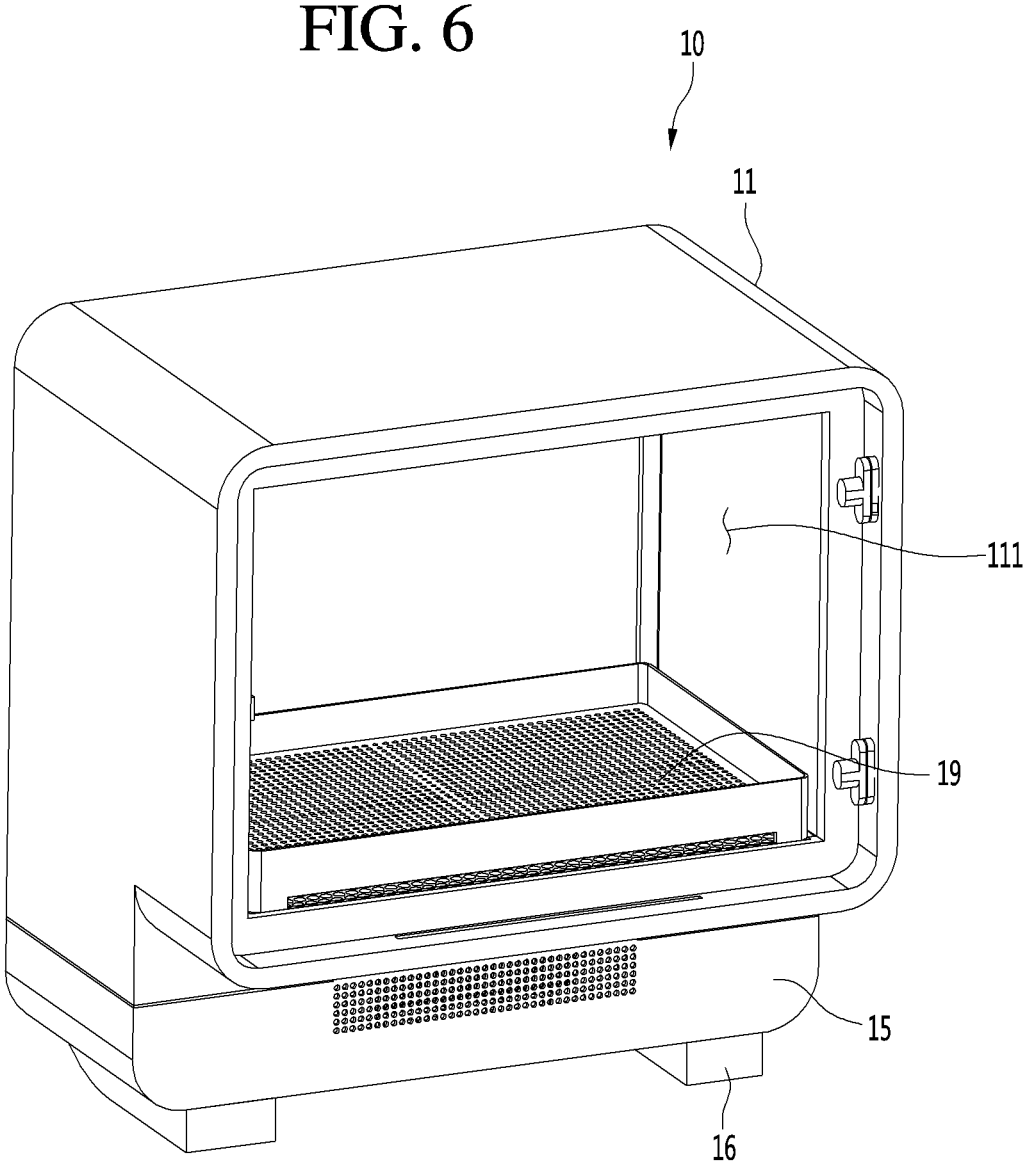
FIG. 6 is a front perspective view of the entrance refrigerator in a state in which an outdoor side door is removed for clarity of illustration, according to an embodiment.
Figure 7:
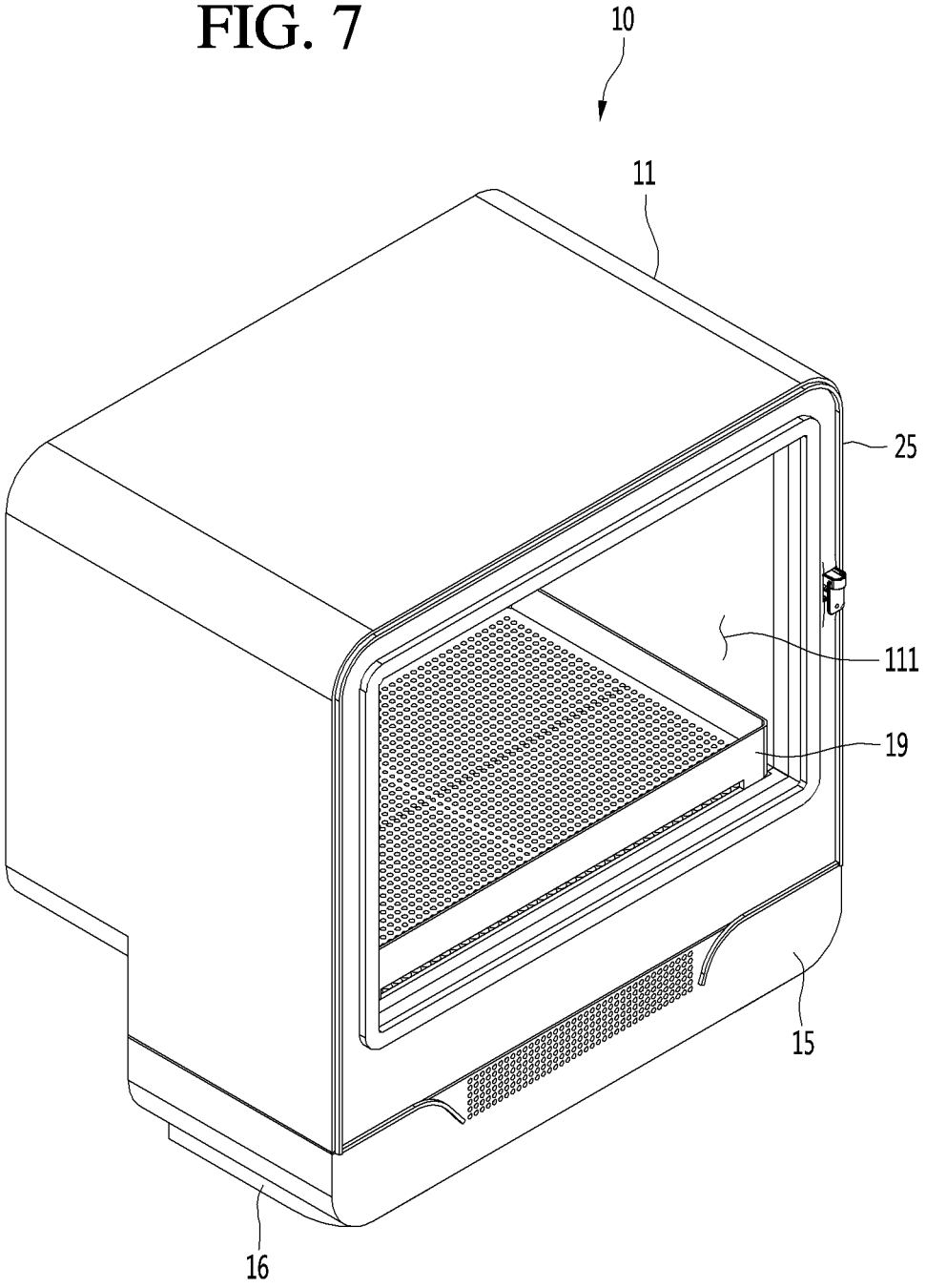
FIG. 7 is a rear perspective view of the entrance refrigerator in a state in which an indoor side door is removed for clarity of illustration, according to an embodiment.

FIG. 6 is a front perspective view of the entrance refrigerator 10 in a state in which the outdoor side door 12 is removed for clarity of illustration, according to an embodiment, and FIG. 7 is a rear perspective view of the entrance refrigerator 10 in a state in which the indoor side door 13 is removed for clarity of illustration, according to an embodiment.

Referring to FIGS. 6 and 7, a storage compartment 111 in which goods may be stored is provided within the cabinet 11. The storage compartment 111 may be considered as a main body of the entrance refrigerator 10 according to the embodiment.

A tray 19 on which goods are placed may be provided at a lower portion of the storage compartment 111.

In addition, a guide rib 25 may be formed along the rear edge of the cabinet 11. The guide rib 25 may protrude a predetermined distance from the rear surface of the cabinet 11 and extend along an edge of the cabinet 11. The guide rib 25 is provided to guide some of the air discharged from the housing 15 upwardly to the area surrounding the indoor side door 13 so that condensation is prevented from forming on a gasket 22 surrounding the rear surface of the indoor side door 13.

Figure 8:
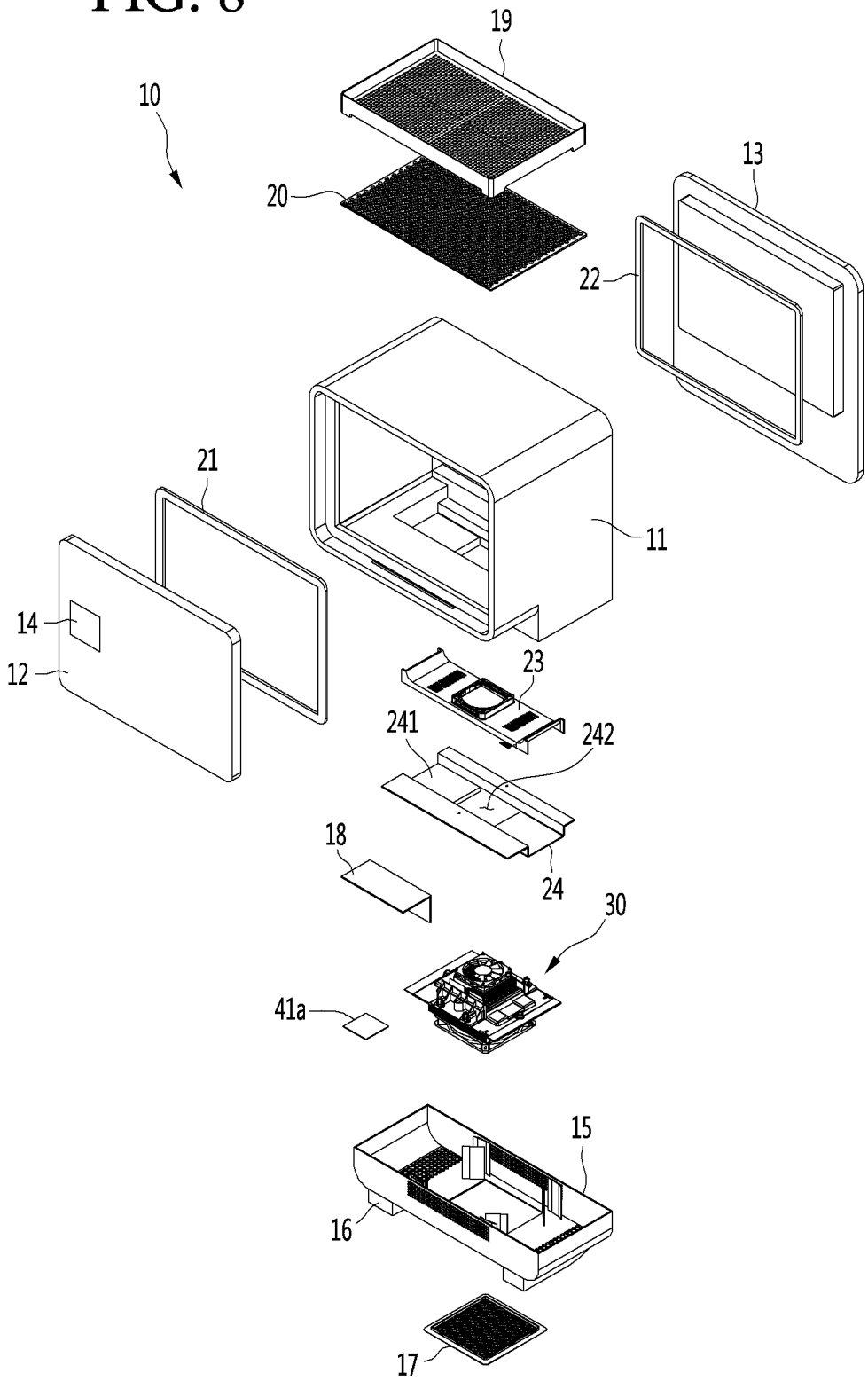
FIG. 8 is an exploded perspective view of the entrance refrigerator according to an embodiment.
Figure 9:
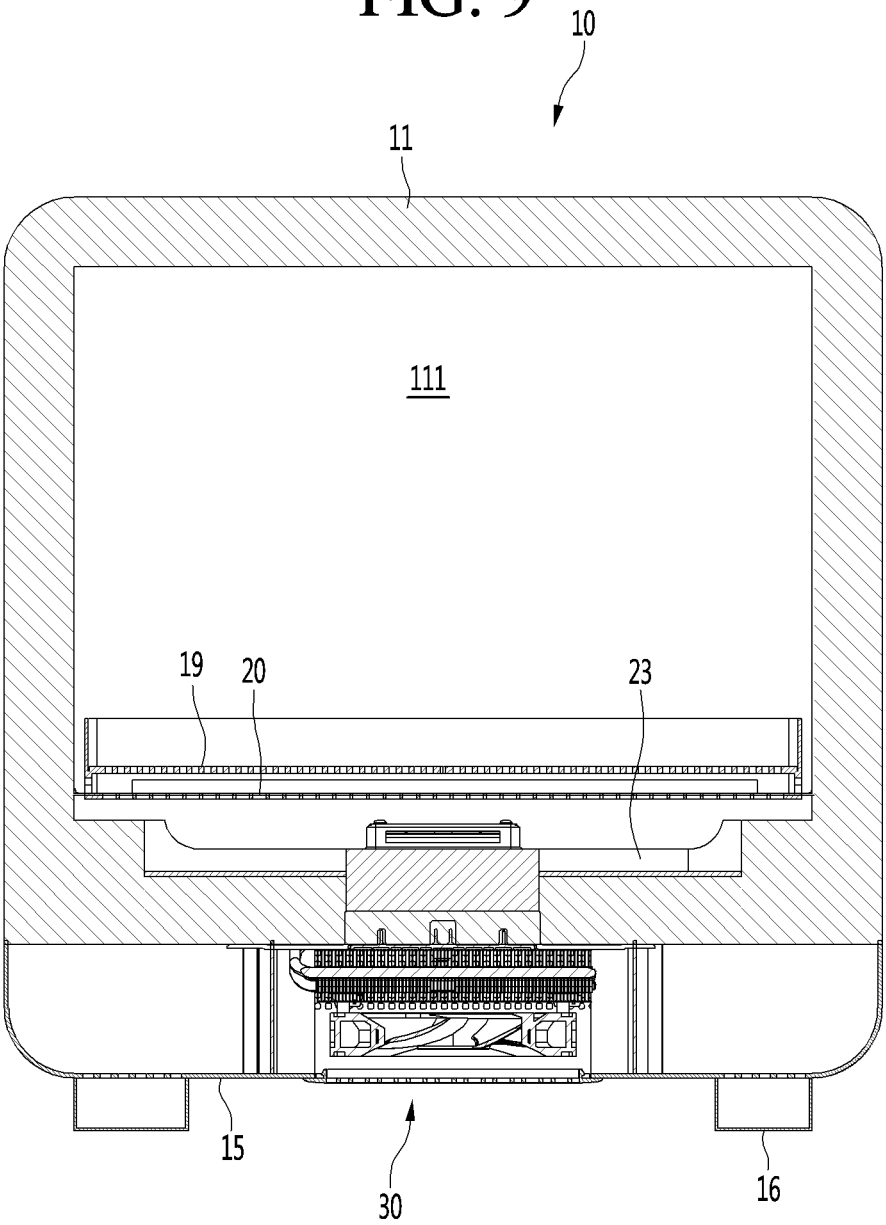
FIG. 9 is a cross-sectional view of the entrance refrigerator, taken along line 9-9 of FIG. 3.
Figure 10:
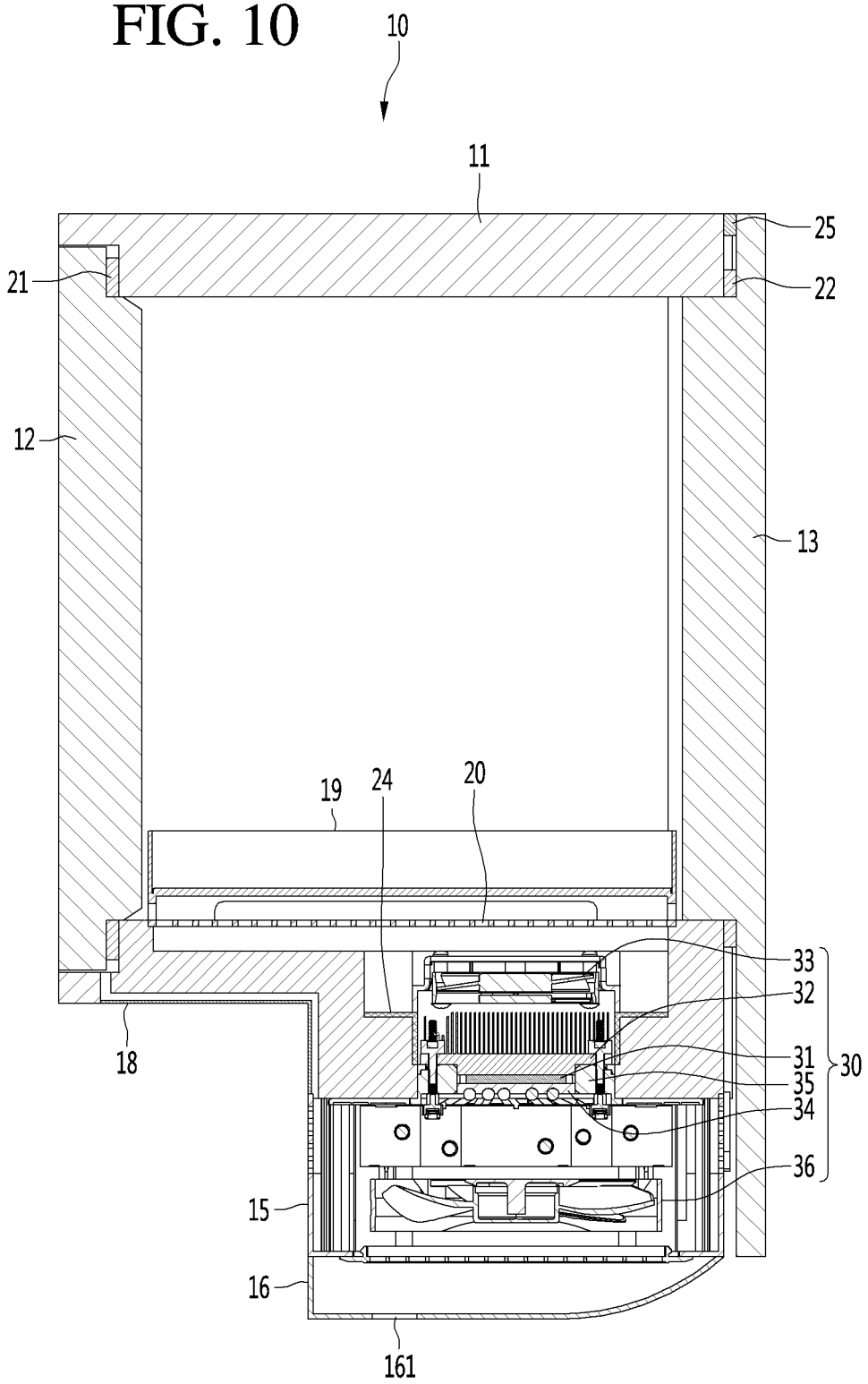
FIG. 10 is a side cross-sectional view of the entrance refrigerator, taken along line 10-10 of FIG. 3.

FIG. 8 is an exploded perspective view of the entrance refrigerator 10 according to an embodiment, FIG. 9 is a cross-sectional view of the entrance refrigerator 10, taken along line 9-9 of FIG. 3, and FIG. 10 is a side cross-sectional view of the entrance refrigerator 10, taken along line 10-10 of FIG. 3.

Referring to FIGS. 8 to 10, as described above, the entrance refrigerator 10 according to the embodiment may include the cabinet 11, the indoor side door 13, the outdoor side door 12, the housing 15, the guide duct 16, the suction plate 17, and the tray 19.

The entrance refrigerator 10 may further include a base plate 20 disposed at the bottom portion of the cabinet 11. The tray 19 may be disposed above the base plate 20. The bottom surface of the tray 19 may be spaced apart upward from the base plate 20.

The entrance refrigerator 10 may further include a cold air supply device 30 accommodated in the housing 15.

The cold air supply device 30 may be a device to which a thermoelectric element (Peltier element) is applied, but the cold air supply device 30 is not limited thereto. For example, a general cooling cycle may be applied to the cold air supply device 30.

When a current is supplied to the thermoelectric element, one surface thereof acts as a heat absorbing surface in which a temperature drops, and the other surface thereof acts as a heat generating surface in which a temperature increases. In addition, when the direction of the current supplied to the thermoelectric element is changed, the heat absorbing surface and the heat generating surface are swapped.

In detail, the cold air supply device 30 may include a thermoelectric element 31, a cold sink 32 attached to the heat absorbing surface of the thermoelectric element 31, a heat absorption fan 33 disposed above the cold sink 32, a heat sink 34 attached to the heat generating surface of the thermoelectric element 31, a heat dissipation fan 36 disposed below the heat sink 34, and an insulation material 35 for preventing heat transfer between the cold sink 32 and the heat sink 34.

The insulation material 35 is provided to surround the side surface of the thermoelectric element 31. The cold sink 32 comes into contact with the upper surface of the insulation material 35, and the heat sink 34 comes into contact with the lower surface of the insulation material 35.

The cold sink 32 and the heat sink 34 may include a thermal conductor directly attached to the heat absorbing surface and the heat generating surface, respectively, of the thermoelectric element 31, and a plurality of heat exchange fins extending from the surface of the thermal conductor.

The heat absorption fan 33 is disposed to face the inside of the cabinet 11, and the heat dissipation fan 36 is disposed directly above the suction plate 17.

The entrance refrigerator 10 may further include a mount plate 24 mounted on the bottom of the cabinet 11, and a flow guide 23 mounted on the upper surface of the mount plate 24.

The mount plate 24 may be formed in a shape in which a rectangular plate is bent a plurality of times to include a bottom portion, a pair of upstanding side portions, and a pair of outwardly extending flange portions. The mount plate 24 may be formed in a shape in which a flow guide seating portion 241, on which the flow guide 23 is seated, is recessed or stepped to a predetermined depth. A through-hole 242 is formed at the bottom portion of the mount plate 24 defining the flow guide seating portion 241. A portion of the cold air supply device 30 may pass through the through-hole 242 and be mounted to the mount plate 24.

In addition, the flow guide 23 may be understood as a device for forming the flow path of the air inside the storage compartment 111 which forcibly flows by the heat absorption fan 33.

The base plate 20 may be disposed above the flow guide 23 to minimize a possibility that foreign substances could fall directly onto the flow guide 23.

An outer gasket 21 is provided on an inner side of the outdoor side door 12 that faces the cabinet 11, and an inner gasket 22 is provided on an inner side of the indoor side door 13 that faces the cabinet 11. The outer gasket 21 and the inner gasket 22 prevent cold air within the storage compartment 111 from leaking to the outside of the entrance refrigerator 10. Alternatively, the outer gasket 21 may be provided on a portion of the cabinet 11 that faces an inner side of the outdoor side door 12, and the inner gasket 22 may be provided on a portion of the cabinet 11 that faces an inner side of the indoor side door 13. The portion of the cabinet 11 may be a contact shoulder 115 to be described later. The outer gasket 21 and the inner gasket 22 prevent cold air within the storage compartment 111 from leaking to the outside of the entrance refrigerator 10.

Figure 11:
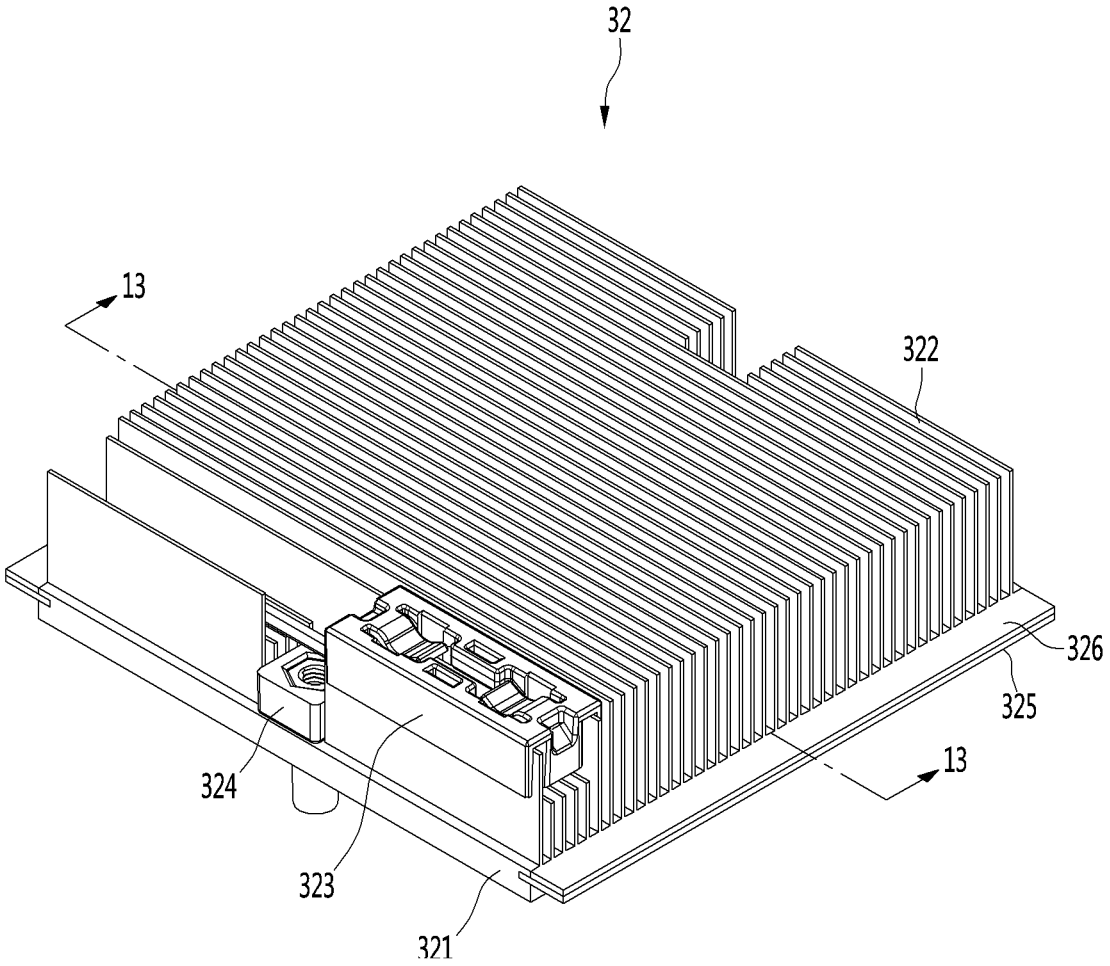
FIG. 11 is a front perspective view of a cold sink of a cold air supply device according to an embodiment.
Figure 12:
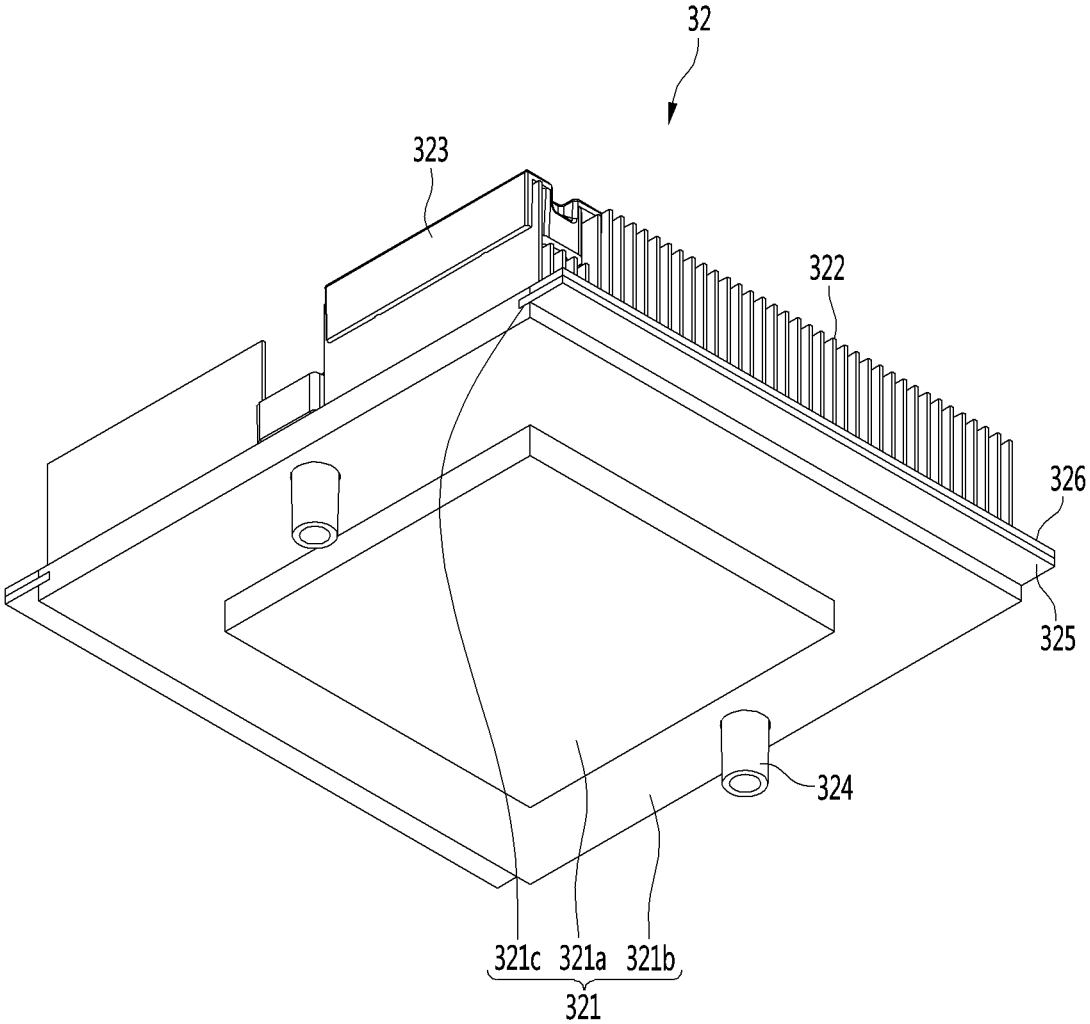
FIG. 12 is a bottom perspective view of the cold sink according to an embodiment.
Figure 13:
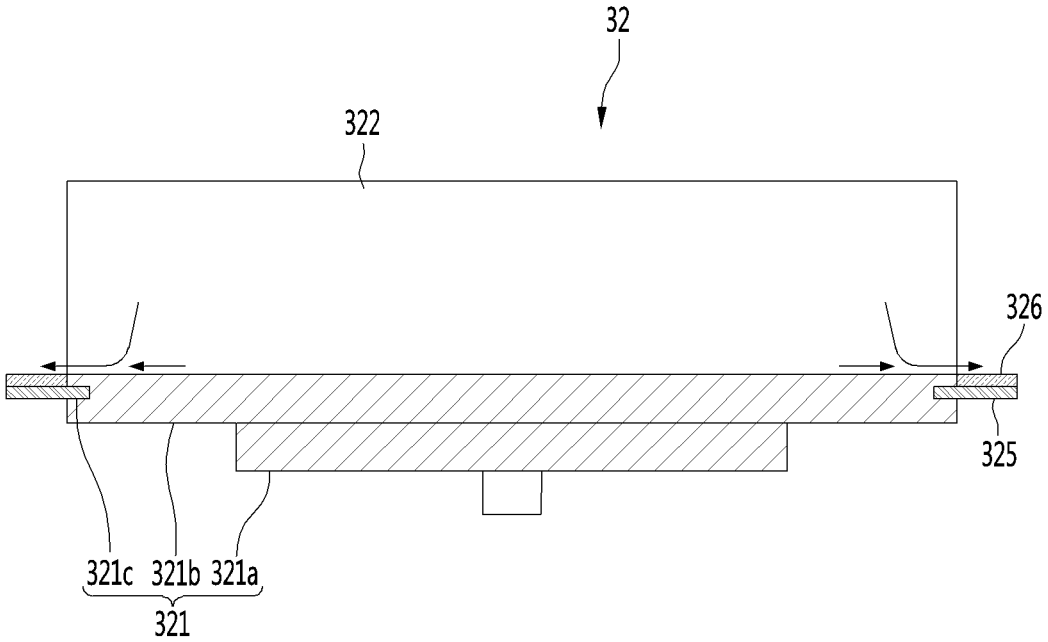
FIG. 13 is a longitudinal cross-sectional view taken along line 13-13 of FIG. 11.

FIG. 11 is a front perspective view of a cold sink of a cold air supply device according to an embodiment, FIG. 12 is a bottom perspective view of the cold sink, and FIG. 13 is a longitudinal cross-sectional view taken along line 13-13 of FIG. 11.

Referring to FIGS. 11 to 13, the cold sink 32 of the cold air supply device 30 according to the embodiment may include a sink body 321 and heat exchange fins 322.

In detail, the sink body 321 is a portion forming the base of the cold sink 32. The bottom surface of the sink body 321 is directly attached to the heat absorbing surface of the thermoelectric element 31, such that heat exchange is performed through heat transfer.

The sink body 321 may be a rectangular plate, but the present disclosure is not limited thereto.

In addition, the sink body 321 may include a lower body 321*a* directly attached to the heat absorbing surface of the thermoelectric element 31, and an upper body 321*b* formed on the upper surface of the lower body 321*a* and having a cross-sectional area larger than a cross-sectional area of the lower body 321*a*.

The lower body 321*a* may have the same cross-sectional area as that of the heat absorbing surface of the thermoelectric element 31.

The heat exchange fins 322 protrude from the upper surface of the upper body 321*b*.

The edge of the upper body 321*b* may be spaced apart from the edge of the lower body 321*a* by a predetermined interval, and the insulation material 35 may surround the edge of the upper body 321*b* and the edge of the lower body 321*a*. The insulation material 35 may prevent an occurrence in which the upper body 321*b* and the heat sink 36 exchange heat with each other.

A plurality of heat exchange fins 322 may be arranged on the upper surface of the upper body 321*b* to be spaced apart from each other by a predetermined interval in a front-to-rear direction. The plurality of heat exchange fins 322 may extend from the left end of the upper body 321*b* toward the right end of the upper body 321*b*, with a length corresponding to the width of the upper body 321*b*. The plurality of heat exchange fins 322 may extend from the upper surface of the upper body 321*b* by a predetermined height.

In addition, a sensor assembly may be provided on one edge of the cold sink 32.

In detail, the sensor assembly may include a sensor housing 323, a temperature sensor, and a defrosting sensor mounted inside the sensor housing 323.

The temperature sensor detects the temperature of the storage compartment 111.

In addition, whether to perform the defrosting operation is determined according to a detection value detected by the defrosting sensor.

In addition, the sensor housing 323 may be provided on the end of the heat exchange fin 322 extending from the edge of the cold sink 32.

A fastening boss 324 may be formed at the edge of the sink body 321. The fastening boss 324 may extend from each of the upper surface and the lower surface of the sink body 321 by a predetermined length. The fastening boss 324 may be formed in each of the front end and the rear end of the sink body 321.

The cold sink 32 may include a condensed water absorption device provided on the left surface and the right surface of the sink body 321.

The condensed water absorption device may include a support plate 325 mounted on each of the left surface and the right surface of the sink body 321, and an absorption pad 326 provided on the upper surface of the support plate 325.

An insertion groove 321*c* may be recessed on each of the left surface and the right surface of the sink body 321 by a predetermined depth. The insertion grooves 321*c* may extend from the front end to the rear end of the side surfaces of the sink body 321.

One side end of the support plate 325 is inserted into and fixed to the insertion groove 321*c*.

In a state in which one side end of the support plate 325 is inserted into the insertion groove 321*c*, the other side end of the support plate 325 protrudes from the side surface of the sink body 321 by a predetermined length. A distance from the side surface of the sink body 321 to the other side end of the support plate 325 is defined as the width of the support plate 325. The length of the support plate 325 may be defined as the front-to-rear direction of the sink body 321.

The absorption pad 326 may have a width corresponding to the width of the support plate 325, and a length corresponding to the length of the support plate 325. The absorption pad 326 may be attached to the upper surface of the support plate 325.

The upper surface of the absorption pad 326 may be coplanar with the upper surface of the upper body 321*b*. Alternatively, the upper surface of the absorption pad 326 may be lower than the upper surface of the upper body 321*b*, such that the upper surface of the absorption pad 326 is stepped down in a stair shape.

The absorption pad 326 may be a nonwoven fabric or a desiccant having a function of absorbing water, but the present disclosure is not limited thereto. Any type of material having a water absorbing function may be attached to the upper surface of the support plate 325 in a pad shape.

When a forward voltage is supplied to the thermoelectric element 31 so as to cool the storage compartment 111 of the entrance refrigerator 10, the temperature of the surface of the sink body 321 coming in contact with the lower body 321*a*, that is, the temperature of the heat absorbing surface of the thermoelectric element 31, may be lowered.

At the same time, the temperature of the surface coming in contact with the heat sink 34, that is, the temperature of the heat generating surface of the thermoelectric element 31, may be increased.

When the power is supplied to the heat absorption fan 33 to rotate the heat absorption fan 33, air inside the storage compartment 111 forcibly flows to exchange heat with the cold sink 32. Therefore, the air inside the storage compartment 111 may be lowered to the temperature corresponding to the temperature of the cold sink 32.

As the temperature inside the storage compartment 111 is lowered to a dew point temperature or less, condensation may form on the surface of the cold sink 32, that is, the upper surface of the upper body 321*b* and the surfaces of the heat exchange fins 322.

Due to gravity, the condensation formed on the heat exchange fins 322 flows down to the upper surface of the upper body 321*b*. The condensed water flowing down to the upper surface of the upper body 321*b* flows to the left edge and the right edge of the upper body 321*b*. The condensed water flowing to the left edge and the right edge of the upper body 321*b* is absorbed by the absorption pads 326.

The condensed water absorbed by the absorption pads 326 may be evaporated by cold air introduced into a space between the adjacent heat exchange fins 322 and flowing to the left edge and the right edge of the cold sink 32. As such, the water absorbed by the absorption pads 326 is evaporated by the circulating cold air, and may be defined as defrosting.

When a specific condition is satisfied, one type of defrosting operation may be performed. When this defrosting operation is performed, a reverse voltage is applied to the thermoelectric element 31, and the heat absorbing surface of the thermoelectric element becomes the heat generating surface. The upper body 321*b* of the cold sink 32 is heated, and heat transferred to the upper body 321*b* is also transferred to the support plate 325.

In addition, the heat transferred to the support plates 325 heats the absorption pads 326 to evaporate water absorbed by the absorption pads 326.

Figure 14:
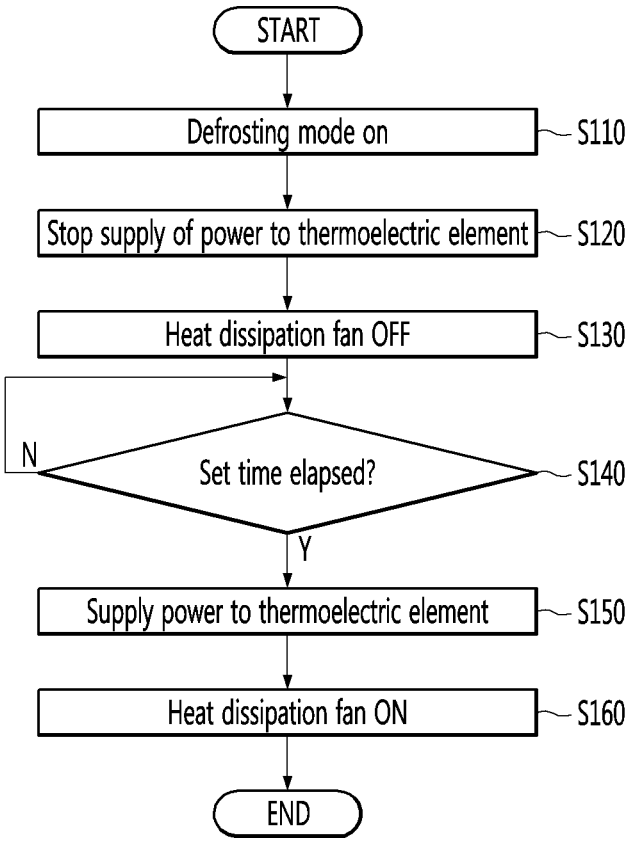
FIG. 14 is a flowchart illustrating a defrosting method of the entrance refrigerator.

FIG. 14 is a flowchart illustrating a natural defrosting method of the entrance refrigerator 10.

Figure 15:
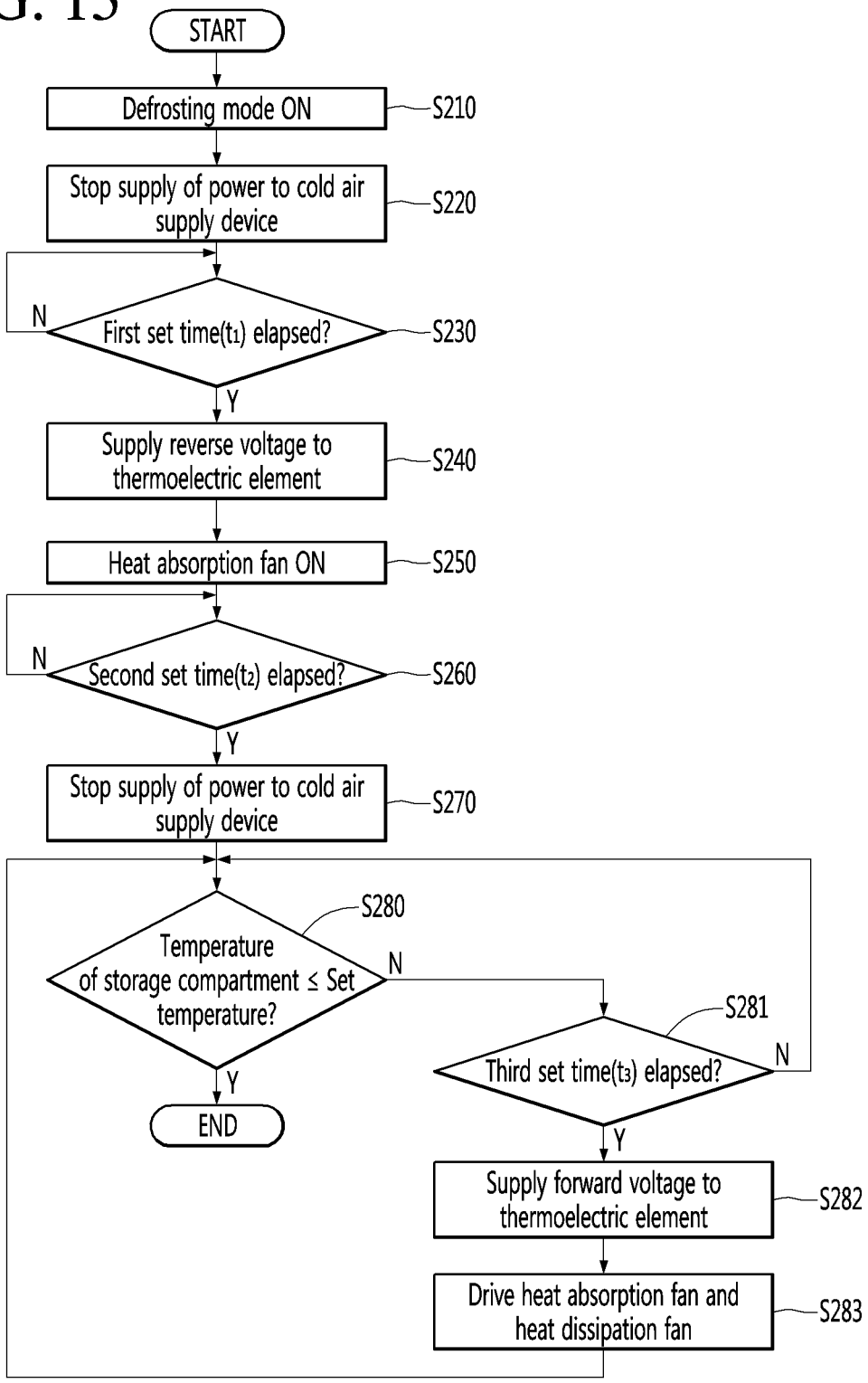
FIG. 15 is a flowchart illustrating a defrosting method of the entrance refrigerator.

Referring to FIGS. 14 and 15, a natural defrosting algorithm and a reverse voltage algorithm may be applied as the defrosting methods of the cold air supply device 30 in which the absorption pads 326 are attached to the left edge and the right edge of the cold sink 32.

The defrosting operation according to FIG. 14 may be understood as a defrosting operation using the natural defrosting algorithm.

First, when a defrosting mode is turned on (S110), the supply of power to the thermoelectric element 31 of the cold air supply device 30 is stopped (S120). The detection value detected by the defrosting sensor described above is transmitted to a controller 41*a* of the entrance refrigerator 10, and the defrosting mode is performed when the controller 41*a* determines that a defrosting operation condition is satisfied.

At the same time as stopping the supply of power to the thermoelectric element 31, the heat dissipation fan 36 is turned off (S130). That is, when the defrosting mode is turned on, the power is supplied only to the heat absorption fan 33, and the supply of power to the thermoelectric element 31 and the heat dissipation fan 36 is stopped.

In this state, since the power is not supplied to the thermoelectric element 31, the heat of the heat generating surface is transferred to the heat absorbing surface. The heat transferred to the heat absorbing surface is transferred to the cold sink 32 by heat transfer. As a result, the temperature of the cold sink 32 rises.

As the temperature of the cold sink 32 rises, frost or ice formed on the surface of the sink body 321 and the heat exchange fins 322 is melted. Water generated by the melted frost or ice is absorbed by the absorption pads 326.

Meanwhile, since the heat absorption fan 33 continuously rotates during the defrosting operation, the air inside the storage compartment 111 continuously contacts the cold sink 32 and flows to the left and right sides of the cold sink 32. At this time, since the cold sink 32 is in a high temperature state, the temperature of the air passing through the cold sink 32 also increases. Therefore, the cold air in the storage compartment, which is forcibly flowing due to the heat absorption fan 33, evaporates water absorbed by the absorption pads 326 to remove defrosted water.

In addition, the heat transferred to the cold sink 32 is transferred to the support plates 325, and the temperature of the support plates 325 also increases. As the temperature of the support plates 325 increases, the defrosted water absorbed by the absorption pads 326 is evaporated.

The evaporated water is distributed in the storage compartment 111 in a gaseous state.

Meanwhile, the controller 41*a* of the entrance refrigerator 10 determines whether a set time elapses from a time point when the supply of power to the thermoelectric element 31 and the heat dissipation fan 36 is stopped (S140). The set time may be understood as the time taken to sufficiently evaporate the water absorbed by the absorption pads 326.

When the controller 41*a* determines that the set time elapses, the controller 41*a* supplies the power to the thermoelectric element 31 and the heat dissipation fan 36 (S150, S160), and the controller 41*a* resumes the cooling operation of the cold air supply device 30.

FIG. 15 is a flowchart illustrating another defrosting method of the entrance refrigerator 10.

Referring to FIG. 15, when the defrosting mode is turned on (S210), the controller 41*a* of the entrance refrigerator 10 stops the supply of power to the cold air supply device 30 (S220).

When a first set time (t1) elapses from a time point when the supply of power to the cold air supply device 30 is stopped (S230), a reverse voltage is applied to the thermoelectric element (S240).

The reverse voltage is applied to the thermoelectric element 31 after the first set time (t1) elapses from the time point when the supply of power to the cold air supply device 30 is stopped in order to minimize thermal impact of the thermoelectric element.

In detail, the voltage applied to the thermoelectric element is not reduced to 0 V immediately when the power supplied to the thermoelectric element is cut off, but is gradually reduced. Therefore, when the supply of the forward voltage is stopped and the reverse voltage is immediately supplied, a residual current remaining in the thermoelectric element and a supplied reverse current collide with each other to damage the circuit inside the thermoelectric element.

For these reasons, it is preferable to set a pause period of a predetermined time when the polarity (or direction) of the current supplied to the thermoelectric element is switched.

At the same time as supplying the reverse voltage to the thermoelectric element 31, the heat absorption fan 33 is turned on (S250). That is, only the heat absorption fan 33 is driven, and the heat dissipation fan 36 is maintained in a stopped state.

When the reverse voltage is applied to the thermoelectric element 31, the heat absorbing surface of the thermoelectric element is switched to the heat generating surface, and the heat generating surface is switched to the heat absorbing surface. Therefore, the temperature of the cold sink 32 increases.

Due to the heat transferred from the thermoelectric element 31 to the cold sink 32, the temperature of the support plates 325 also increases. As a result, the frost or ice formed on the surface of the cold sink 32 is melted, and the melted water flows to the absorption pads 326 and is absorbed by the absorption pads 326.

In addition, as the temperature of the support plates 325 rises, the water absorbed by the absorption pads 326 is evaporated.

At this time, since the heat absorption fan 33 rotates, the cold air in the storage compartment 111 contacts the cold sink 33, and flows to the left side and the right side of the cold sink 33. The cold air in the storage compartment 111, which flows in the horizontal direction of the cold sink 33 due to the heat absorption fan 33, further accelerates the evaporation of the defrosted water absorbed by the absorption pads 326.

When a second set time (t2) required for sufficiently evaporating the defrosted water absorbed by the absorption pads 326 elapses (S260), the supply of power to the cold air supply device 30 is stopped again (S270), and the defrosting operation is ended. That is, the supply of the reverse voltage to the thermoelectric element 31 is stopped, and the rotation of the heat absorption fan is also stopped.

After the defrosting operation is ended, the controller 41*a* detects the temperature of the storage compartment 111 and determines whether the temperature of the storage compartment 111 is maintained at a set temperature (satisfactory temperature) or less (S280).

When it is determined that the temperature of the storage compartment 111 is the satisfactory temperature or less, the operation of the cold air supply device 30 is stopped to end the cooling operation.

However, when it is determined that the temperature of the storage compartment 111 is higher than the set temperature (unsatisfactory temperature), the cooling operation for cooling the storage compartment 111 is performed.

To this end, after a third set time (t3) elapses from the time point when the supply of the reverse voltage to the thermoelectric element 31 is stopped (S281), the forward voltage is supplied to the thermoelectric element 31 (S282). At the same time, the heat absorption fan 33 and the heat dissipation fan 36 are operated (S283).

Like the first set time (t1), the third set time (t3) is a period provided for preventing thermal impact of the thermoelectric element 31. Therefore, the third set time (t3) and the first set time (t1) may be the same amount of time, but the present disclosure is not limited thereto.

When the temperature of the storage compartment 111 is dropped to the satisfactory temperature or less, the supply of power to the cold air supply device 30 is stopped to end the cooling operation.

The second set time (t2) may be longer than the first set time (t1).

In an alternative method, after the second set time (t2) elapses, the controller 41*a* may determine whether the temperature of the storage compartment 111 is in a satisfactory state, and may stop the supply of power to the cold air supply device 30. That is, the order of operation S270 and operation S280 may be reversed.

In this case, when it is determined that the storage compartment 111 is at the satisfactory temperature, the supply of power to the cold air supply device 30 is stopped to end both the defrosting mode and the cooling mode.

However, when it is determined that the storage compartment 111 is at the unsatisfactory temperature, the supply of the reverse voltage to the cold air supply device 30 is stopped, and the cooling mode may be performed by supplying the forward voltage to the thermoelectric element after the third set time (t3) elapses from the time point when the supply of power is stopped.

The above-disclosed subject matter is to be considered illustrative, and not restrictive, and the appended claims are intended to cover all such modifications, enhancements, and other embodiments, which fall within the true spirit and scope of the present disclosure.

Thus, the technical spirit of the present disclosure is not limited to the foregoing embodiment.

Therefore, the scope of the present disclosure is defined not by the detailed description of the invention but by the appended claims, and all differences within the scope will be construed as being included in the present disclosure.

What is claimed is:

1. An entrance refrigerator, comprising:

a cabinet configured to extend through a door or a wall, the cabinet including a storage compartment therein for storing goods;

a housing located at a lower side of the cabinet;

an outdoor side door coupled to an outdoor portion of the cabinet to open or close the storage compartment;

an indoor side door coupled to an indoor portion of the cabinet to open or close the storage compartment;

a cold air supplier configured to supply cold air to the storage compartment, at least a portion of the cold air supplier being located in a space defined by the housing and the lower side of the cabinet; and a controller configured to control operating of the cold air supplier, wherein the cold air supplier comprises:

a thermoelectric element having a heat absorbing surface and a heat generating surface;

a cold sink in contact with the heat absorbing surface;

a heat absorption fan disposed above the cold sink;

a heat sink in contact with the heat generating surface;

a heat dissipation fan disposed below the heat sink; and first and second absorption pads provided at first and second edge portions, respectively, of the cold sink to absorb condensed water generated on a surface of the cold sink.

2. The entrance refrigerator according to claim 1, wherein the cold sink comprises:

a sink body in contact with the heat absorbing surface; and a plurality of heat exchange fins located on an upper surface of the sink body, wherein the first and second absorption pads are located at a left side and a right side, respectively, of the sink body.

3. The entrance refrigerator according to claim 2, wherein the sink body comprises:

a lower body contacting the heat absorbing surface; and an upper body above the lower body, the upper body having an area larger than an area of the lower body, wherein the heat exchange fins protrude from an upper surface of the upper body, extend lengthwise along a left-to-right direction of the upper body, and are spaced apart from each other in a front-to-rear direction of the upper body.

4. The entrance refrigerator according to claim 3, further comprising first and second support plates located at a left side and a right side, respectively, of the upper body, wherein the first and second absorption pads are provided on the first and second support plates, respectively.

5. The entrance refrigerator according to claim 4, wherein an upper surface of each of the first and second absorption pads is coplanar with an upper surface of the upper body.

6. The entrance refrigerator according to claim 4, wherein an upper surface of each of the first and second absorption pads is lower than an upper surface of the upper body.

7. The entrance refrigerator according to claim 4, wherein the left side of the upper body includes a first insertion groove into which a portion of the first support plate is inserted, and wherein the right side of the upper body includes a second insertion groove into which a portion of the second support plate is inserted.

8. The entrance refrigerator according to claim 1, wherein the controller is further configured to control the cold air supplier to provide a defrosting mode in which the controller:

provides a supply of power to the heat absorption fan, stops a supply of power to the thermoelectric element, and stops a supply of power to the heat dissipation fan.

9. The entrance refrigerator according to claim 8, wherein the controller is further configured to resume the supply of power to the thermoelectric element and to the heat dissipation fan after a set time elapses from a time point when the supply of power to the thermoelectric element and to the heat dissipation fan is stopped.

10. The entrance refrigerator according to claim 1, wherein the controller is further configured to control the cold air supplier to provide a defrosting mode in which the controller:

stops a supply of power to the cold air supplier, and supplies a reverse voltage to the thermoelectric element after a first set time elapses from a time point when the controller stops the supply of power to the cold air supplier.

11. The entrance refrigerator according to claim 10, wherein the controller is further configured to, when the reverse voltage is being supplied to the thermoelectric element, supply power to the heat absorption fan.

12. The entrance refrigerator according to claim 11, wherein the controller is further configured to, after a second set time elapses from a time point when the controller begins to supply the reverse voltage to the thermoelectric element, stop the supply of power to the thermoelectric element and the heat absorption fan.

13. The entrance refrigerator according to claim 12, wherein the second set time is longer than the first set time.

14. The entrance refrigerator according to claim 12, wherein the controller is further configured to, when a temperature of the storage compartment is higher than a set temperature, and after a third set time elapses from a time point when the controller stops the supply of the reverse voltage to the thermoelectric element, supply a forward voltage to the thermoelectric element.

15. The entrance refrigerator according to claim 14, wherein the controller is further configured to:

when the forward voltage is supplied to the thermoelectric element, perform a cooling mode by supplying power to the heat absorption fan and the heat dissipation fan; and when the temperature of the storage compartment is equal to or lower than the set temperature, end the cooling mode by stopping the supply of power to the thermoelectric element, the heat absorption fan and the heat dissipation fan.

16. A refrigerator, comprising:

a cabinet configured to be located partially within a barrier of a building, the cabinet including a storage compartment therein, the cabinet having a first opening into the storage compartment and a second opening into the storage compartment, the second opening being spaced from the first opening;

a housing located at a lower side of the cabinet;

a first door coupled to the cabinet to open or close the first opening;

a second door coupled to the cabinet to open or close the second opening; and a cold air supplier configured to supply cold air to the storage compartment, at least a portion of the cold air supplier being located within the housing, wherein the cold air supplier comprises:

a thermoelectric element having a heat absorbing surface and a heat generating surface;

a cold sink in contact with the heat absorbing surface;

a heat absorption fan disposed above the cold sink;

a heat sink in contact with the heat generating surface;

a heat dissipation fan disposed below the heat sink; and first and second absorption pads provided at first and second edge portions, respectively, of the cold sink to absorb condensed water generated on a surface of the cold sink.

17. The refrigerator according to claim 16, wherein the cold sink comprises:

a sink body having a lower surface, an upper surface, a first side and a second side; and a plurality of heat exchange fins located on the upper surface of the sink body, wherein the lower surface of the sink body contacts the heat absorbing surface of the thermoelectric element, wherein the first and second absorption pads are located at the first side and the second side, respectively, of the sink body, and wherein an upper surface of each of the first and second absorption pads is coplanar with or lower than the upper surface of the sink body.

18. A method of controlling a refrigerator, the refrigerator including a storage compartment, a cold air supplier configured to supply cold air to the storage compartment, the cold air supplier including a thermoelectric element having a heat absorbing surface and a heat generating surface, and a heat absorption fan, and a controller configured to control operating of the cold air supplier, the method comprising controlling the cold air supplier to provide a defrosting mode by:

stopping a supply of power to the cold air supplier;

supplying a reverse voltage to the thermoelectric element after a first set time elapses from a time point when the controller stops the supply of power to the cold air supplier; and supplying power to the heat absorption fan when the reverse voltage is being supplied to the thermoelectric element.

19. The method according to claim 18, further comprising stopping the supply of power to the thermoelectric element and the heat absorption fan after a second set time has elapsed from a time point when the controller begins to supply the reverse voltage to the thermoelectric element.

20. The method according to claim 19, further comprising supplying a forward voltage to the thermoelectric element when a temperature of the storage compartment is higher than a set temperature, and after a third set time has elapsed from a time point when the controller stops the supply of the reverse voltage to the thermoelectric element.

* * * * *